US006453863B1

(12) United States Patent
Pels et al.

(10) Patent No.: US 6,453,863 B1
(45) **Date of Patent: *Sep. 24, 2002**

(54) METHOD AND STARTER SYSTEM FOR STARTING AN INTERNAL COMBUSTION ENGINE

(75) Inventors: Thomas Pels, Achern (DE); Franz Rosskopf, München (DE)

(73) Assignees: Continental ISAD Electronic Systems GmbH & Co. KG, Landsberg (DE); Bayerische Moteren Werke Aktiehgesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/693,197

(22) Filed: Oct. 20, 2000

Related U.S. Application Data

(63) Continuation of application No. PCT/EP99/02219, filed on Mar. 31, 1999.

(30) Foreign Application Priority Data

Apr. 21, 1998 (DE) ..... 198 17 497

(51) Int. Cl.[7] ..... F02N 11/08

(52) U.S. Cl. ..... 123/179.3

(58) Field of Search ..... 123/179.3, 179.4, 123/179.25, 179.28

(56) References Cited

U.S. PATENT DOCUMENTS

| | | | | | |
|---|---|---|---|---|---|
| 3,908,130 | A | * | 9/1975 | Lafuze | 290/46 |
| 5,101,780 | A | * | 4/1992 | Jones | 123/182.1 |
| 5,146,095 | A | * | 9/1992 | Tsuchiya et al. | 290/38 R |
| 5,713,320 | A | * | 2/1998 | Pfaff et al. | 123/179.3 |
| 6,177,734 | B1 | * | 1/2001 | Masberg et al. | 290/31 |
| 6,202,615 | B1 | * | 3/2001 | Pels et al. | 123/179.21 |

FOREIGN PATENT DOCUMENTS

| | | |
|---|---|---|
| DE | AS 1 036 578 | 8/1958 |
| DE | 31 17 144 A1 | 11/1982 |
| DE | 42 00 606 A1 | 7/1993 |
| DE | 44 06 481 A1 | 9/1995 |
| DE | 297 23 175 U1 | 6/1998 |
| DE | 197 41 294 A1 | 3/1999 |
| EP | 0 569 347 A2 | 11/1993 |
| FR | 2 569 776 | 3/1986 |
| WO | WO 91/16538 | 10/1991 |
| WO | WO 99/54621 | 10/1999 |

OTHER PUBLICATIONS

*International Search Report*, corresponding to International Application Serial No. PCT/EP99/02219—International Publication No. WO 99/54621, dated Jul. 15, 1999, 4 pages.

English–language translation of the *International Preliminary Examination Report*, corresponding to International Application Serial No. PCT/EP99/02219—International Publication No. WO 99/54621, dated Oct. 30, 2000, 5 pages.

* cited by examiner

*Primary Examiner*—Gene Mancene
*Assistant Examiner*—Arnold Castro
(74) *Attorney, Agent, or Firm*—Marshall, Gerstein & Borun

(57) ABSTRACT

A method for starting an internal combustion engine and a starter system is disclosed. The crankshaft of an internal combustion engine is accelerated at least to the starting speed required for starting the internal combustion engine. The crankshaft is brought to a stipulated crank angle for the starting process by an electric machine before the actual starting process, and the starting process is started from this crank angle.

20 Claims, 4 Drawing Sheets

METHOD AND STARTER SYSTEM FOR STARTING AN INTERNAL COMBUSTION ENGINE

RELATED APPLICATION

This application is a continuing application claiming priority under 35 U.S.C. §120 from International Patent Application Serial No. PCT/EP99/02219, filed Mar. 31, 1999.

FIELD OF THE INVENTION

The present invention concerns a method for starting an internal combustion engine, as well as a starter system for an internal combustion engine.

BACKGROUND OF THE INVENTION

It is known from practice that internal combustion engines (for example, in vehicles), cannot be started from their own power. They must initially be cranked by an external power source (the so-called starter), and accelerated to the engine speed required for starting of the internal combustion engine. Only then can they continue to run under their own power.

A battery-fed DC motor is often used as the electric starter in vehicles. This motor transfers the necessary starting torque to the crankshaft of the internal combustion engine via a drive pinion that engages in a toothed ring on the disk flywheel. A starter system with an electric starter motor, whose rotor sits directly on the crankshaft of the internal combustion engine and is connected to rotate in unison with it, is also known from DE 44 06 481 A1. With this type of arrangement, the weight of the rotor of the electric machine is simultaneously used as flywheel mass.

An improved starter system of this type is also known from EP 0 569 347 A2 and WO 91/16538.

The starting torque of an internal combustion engine and the minimum starting speed depend, among other things, on engine type, working volume, number of cylinders, bearing friction, compression and mixture preparation and, above all, on temperature. The section of the operating process, in which the cylinder or cylinders of the engine are situated during starting, is also significant for compression of an internal combustion engine and therefore for its readiness to start. Thus, for example, the compression of a cylinder situated in the compression stroke has an unfavorable effect on starting behavior, because it opposes the starter with increased torque right at the beginning of starting. Thus far in the prior art this variable has not been adequately considered. Known starters in each case had to be designed according to power, so that the internal combustion engine can be started under all conditions.

OVERVIEW OF THE DISCLOSED DEVICE

In the disclosed method for starting an internal combustion engine, the crankshaft of the internal combustion engine is accelerated at least to a speed (so-called starting speed) necessary for starting the internal combustion engine. An electric machine is used for this acceleration, whose rotor acts directly on the crankshaft or via a transmission connected in between. The crankshaft is also brought to a stipulated crank angle position or stipulated crank angle (hereafter "starting angle") by means of the electric machine for the starting process and the internal combustion engine is started from this starting angle. The power required for starting is taken at least partially from a capacitor accumulator. The actual starting process of the internal combustion engine can then begin from a favorable starting angle and is additionally fed, at least partially, from the capacitor accumulator (not fully from a starter battery, as usual), which can deliver the necessary electrical starting power much more quickly than an ordinary battery. Moreover, a capacitor accumulator is much less temperature-sensitive than an electrochemical battery, so that, even at very low temperatures, problem-free starting is possible.

Charging of the capacitor accumulator can occur in different ways. One possibility comprises charging the capacitor accumulator only before starting from a starter battery. The command that triggers the adjustment process of the crankshaft starting angle is preferably simultaneously used as signal to charge the capacitor accumulator from the starter battery. Starting of the internal combustion engine can then occur without any waiting time.

A disclosed starter system for an internal combustion engine includes: an electric machine, whose rotor is connected directly to rotate in unison with the crankshaft of the internal combustion engine or via a transmission connected in between, in order to accelerate the internal combustion engine at least to a speed (starting speed) necessary for starting; means to record and/or derive the crank angle of the internal combustion engine; a control device that controls the electric machine, so that the crank angle of the internal combustion engine is brought to a stipulated starting angle for the starting process; and a capacitor accumulator (for example, a so-called intermediate circuit accumulator), which at least partially supplies the power required for starting. The capacitor accumulator can preferably also be a combination of electrical capacitor elements and electrochemical battery elements.

The inventors recognized that the position of the crankshaft at the beginning of starting is of considerable importance for the starting behavior of an internal combustion engine. Based on this recognition, the inventors further recognized that, by influencing the crank angle before the actual starting process, as well as the type of starting power supply, a significant improvement in starting behavior of an internal combustion engine can be achieved. By means of the electric machine (for example, a so-called crankshaft starter with a rotor connected to rotate in unison directly with the crankshaft), it is possible to apply the torques necessary for adjustment of a desired starting angle in both directions of rotation of the crankshaft and with high accuracy. In this manner, an unfavorable crankshaft position at the beginning of starting is avoided, for example, when one or more cylinders of an internal combustion engine compress right at the beginning, and starting can thus be achieved with reduced starting power. In terms of the device, the starter system has a control device for this purpose, which, knowing the instantaneous crank angle, controls the rotor of the electric machine (optionally with consideration of the transmission ratio between the rotor and crankshaft), so that the crankshaft is brought to the desired starting angle.

Use of the disclosed starter system is advantageous both in spark ignition engines and diesel engines (for example, four-stroke engines with manifold injection or with direct injection), which are designed for use in passenger cars.

In a preferred variant, the crank angle at which the starting torque to be applied by the electric machine is lower at the beginning of the starting process than in the known starter systems is chosen as the starting angle. In an internal combustion engine operating, for example, in the four-stroke method, the cylinder pressure, and therefore the compression to be overcome by a starter, increases during a compression stroke and reaches its maximum roughly in the region of top dead center. If, in a preferred variant for a four-stroke internal combustion engine, the crank angle for the next start is set at the end of the compression stroke, preferably in a region right after top dead center, at the beginning of starting, the starter need only overcome the relatively low-compression suction stroke of the internal combustion engine. Moreover, almost two full revolutions remain for the starter at the beginning of starting, in order to build up sufficient starting power to overcome the next compression stroke. This is particularly favorable in a cold start.

In another variant, the crank angle at which the starting time (i.e., the time from the beginning of starting to starting of the internal combustion engine), is reduced to a minimum is chosen as starting angle. In a four-stroke internal combustion engine with manifold injection, this is preferably the crank angle position at the beginning of the suction stroke, with particular preference in the intersection region between the exhaust and suction stroke. On the other hand, in a four-stroke internal combustion engine with direct injection, the crank angle position is preferably at the end of the suction stroke. If the internal combustion engine is also equipped with an ordinary sensor system comprising an inductive sensor and gear with reference marks to record the crank angle, the starting angle adjustment process, and thus the starting time, can also be shortened, so that the starting angle is chosen in the region right before the reference mark of the rotation angle sensor. Rotation angle recording can then be carried out without a delay right at the beginning of the starting process.

If starting can occur without any delay, this also serves for traffic safety and increases operating comfort of vehicles. Moreover, the amount of power required overall to start an internal combustion engine is then lower, which advantageously permits smaller dimensioning of the starter power accumulator.

The discussion thus far has applied equally to one-cylinder and multicylinder engines, if selection of the crankshaft starting angle is adjusted to that cylinder of a multicylinder engine that is ignited first. Generally, the sequence in which the cylinders are ignited in succession is stipulated. However, in another variant, at least during selection of the cylinder ignited first, a deviation is made from the stipulated ignition sequence and a specific cylinder is selected for the first ignition as a function of the starting angle of the crankshaft being adjusted.

The internal combustion engine is preferably brought automatically to a starting angle favorable for the next start already during disengagement or right after disengagement of ignition of the internal combustion engine by means of the electric machine arranged in the drive train, for example, in which the electric machine has a braking or accelerating effect on the crankshaft of the running out internal combustion engine. As an alternative to this approach, the desired starting angle is set only right before the beginning of the starting process automatically, for example, in which the electric machine rotates the crankshaft of the stopped internal combustion engine forward or backward into the desired starting angle. An undesired "adjustment" of the starting angle, once set, in the time between the adjustment process and the starting process is therefore ruled out. It is particularly favorable if the power required for starter operation, in conjunction with the last-named variant, is at least partially taken from a capacitor accumulator.

For adjustment of the starting angle of the crankshaft, the instantaneous crank angle is determined, compared with the value of the stipulated crankshaft starting angle in the control device and any change in crank angle also monitored. For this purpose, an angle recording integrated in the electric machine is preferably used. With particular preference, an appropriate rotation angle sensor is coordinated with the rotor of the electric machine (for example, an inductive or optical rotation angle sensor). The rotation angle of the electric machine, however, can also be determined from the magnetic reflux of the rotor in the stator of the electric machine. Since the rotor of the electric machine is connected either directly to the crankshaft of the internal combustion engine or via a transmission, the crank angle is obtained directly or by simple conversion, with consideration of the transmission ratio.

In principle, any type of electric machine which is capable of applying the necessary torques and precisely carrying out the desired crank angle adjustment is suitable for use with the disclosed starter system, be it a DC, AC, three-phase asynchronous or three-phase synchronous machine. The electric machine/motor of the starter system is preferably an electric machine functioning as a starter/generator, which preferably permanently runs with the internal combustion engine. With particular preference, the electric machine of the starter system is an inverter-controlled three-phase machine. Three-phase machine is understood to mean a machine, in which a magnetic rotating field occurs that rotates by 360° and, in so doing, drives the rotor. The inverter receives signals from the control device and produces alternating currents with freely adjustable frequency, amplitude and phase. This type of arrangement is excellently suited for applying high torques in both directions of rotation of the crankshaft.

Embodiments and features that were outlined above, or will be outlined subsequently in conjunction with the process, naturally also apply as disclosed in conjunction with the corresponding starting system (and vice versa).

Other features and advantages are inherent in the disclosed apparatus or will become apparent to those skilled in the art from the following detailed description and its accompanying drawings.

DETAILED DESCRIPTION OF THE ILLUSTRATED DEVICE

Figure 1:
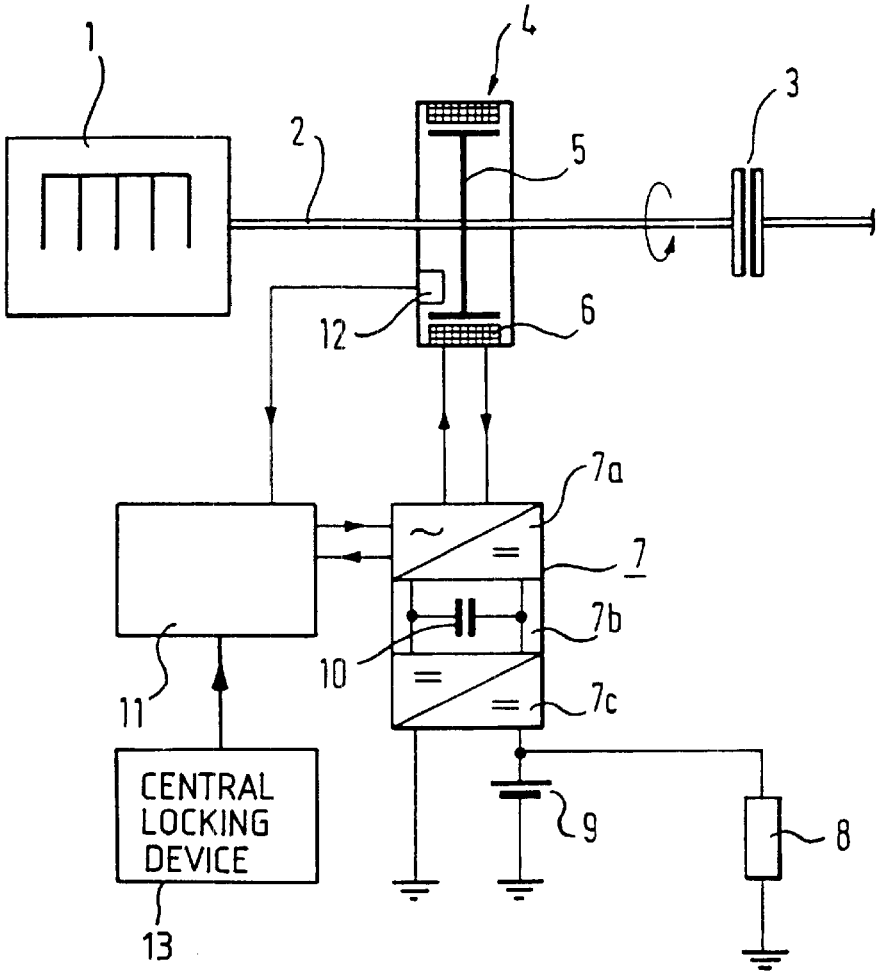
FIG. 1 shows a schematic view of a starter system with an internal combustion engine.

The starter system according to FIG. 1 is intended for example, for a vehicle such as a passenger car. It has a four-cylinder internal combustion engine 1 operating according to the four-stroke method, which delivers torques via a crankshaft 2, a clutch 3 and additional (not shown) parts of a drive train to the drive wheels of the vehicle. In the present practical example, an electric machine 4 serving as starter/generator (here an asynchronous three-phase machine), is arranged directly on crankshaft 2. It has a rotor 5 sitting directly on crankshaft 2 and connected to rotate in unison with it, as well as a stator 6 supported on the housing of internal combustion engine 1. This type of electric machine has a high initial breakaway torque for starter operation.

In other variants (not shown), the rotor of an electric machine (for example, a DC inverse-speed motor), is coupled via a transmission to the crankshaft 2, optionally via a single-track gear connected in between.

In the practical example according to FIG. 1, the winding of stator 6 of electric machine 4 (not shown) is fed by an inverter 7 with electrical alternating currents or voltages of almost freely adjustable amplitude, phase and frequency. This is preferably a DC intermediate circuit inverter, which is constructed from a DC-AC frequency converter 7*a* on the machine side, a DC intermediate circuit 7*b* and a DC converter 7*c* on the electrical system side. The latter is coupled to a vehicle electrical system 8 and an electrical system long-term accumulator 9 (for example, an ordinary lead-sulfuric acid battery). A short-term accumulator (here a capacitor accumulator 10), is connected in the intermediate circuit 7*b*.

The electric machine 4 and the inverter 7 are designed so that they can apply the required torque in both directions of rotation of crankshaft 2 to adjust a desired crank angle position before the beginning of starting, and also to apply the starting power required during starting for direct cranking of crankshaft 2 to the required starting speed. A superordinate control device 11 controls the starting angle adjustment process and the starting process, in which it controls inverter 7 and the DC-AC converter 7*a* and DC converter 7*c*. The control device 11 receives the actual rotational angle of rotor 5 from an inductive rotation angle sensor 12 integrated in electric machine 4 (for example, installed in its housing and connected to rotor 5). The measured rotor angle corresponds to the crank angle of crankshaft 2, based on direct coupling of rotor 5 to crankshaft 2. The starting process is prepared in a special way. After the end of motor operation (for example, during or right after disengagement of ignition of the vehicle), the control device 11 controls the electric machine 4 via inverter 7, so that the crankshaft 2 is brought into a crank angle position favorable for the next start. In this case, the electric machine 4, in alternation, transfers braking or accelerating torques to the crankshaft 2 of the running out engine 1, in order to set the desired crank angle. With engine 1 stopped, the electric machine 4 can also be operated so that the crankshaft 2 is rotated forward or backward to the desired crank angle, in order to set the desired crank angle (for example, in the fashion of "lowest torque to be applied"). This need not necessarily also be the "shortest" path.

The "optimal" crank angle (i.e., the starting angle), for starting of an internal combustion engine depends, among other things, on the engine type, number of cylinders and ignition sequence, and also on the sought starting behavior (for example, whether a low starting torque for the next start is desired at the beginning of the starting process or a shortened starting time). For a four-cylinder, four-stroke internal combustion engine as shown in FIG. 1, a favorable starting angle with limited starting torque lies in a region directly after top dead center of the first ignited cylinder. Since the two outer cylinders in a four-cylinder straight-type engine are ordinarily operated in the same direction, but in the opposite direction to the two inner cylinders, the favorable starting angle therefore lies directly after top dead center of the two outer cylinders of internal combustion engine 1.

The advantage of this adjusted starting angle is that the breakaway torque to be applied at the beginning of the subsequent starting process of the start of machine 4 is much smaller than in the known starter systems. If the internal combustion engine 1 is started from this adjusted crank angle position, at least the two outer cylinders of the internal combustion engine 1 oppose the electric machine 4 with a relatively limited (mostly friction-related) torque. Up to the next compression stroke (of the two inner cylinders), the electric machine 4 can supply the system with sufficient (starting) power to overcome the compression.

Figure 2:
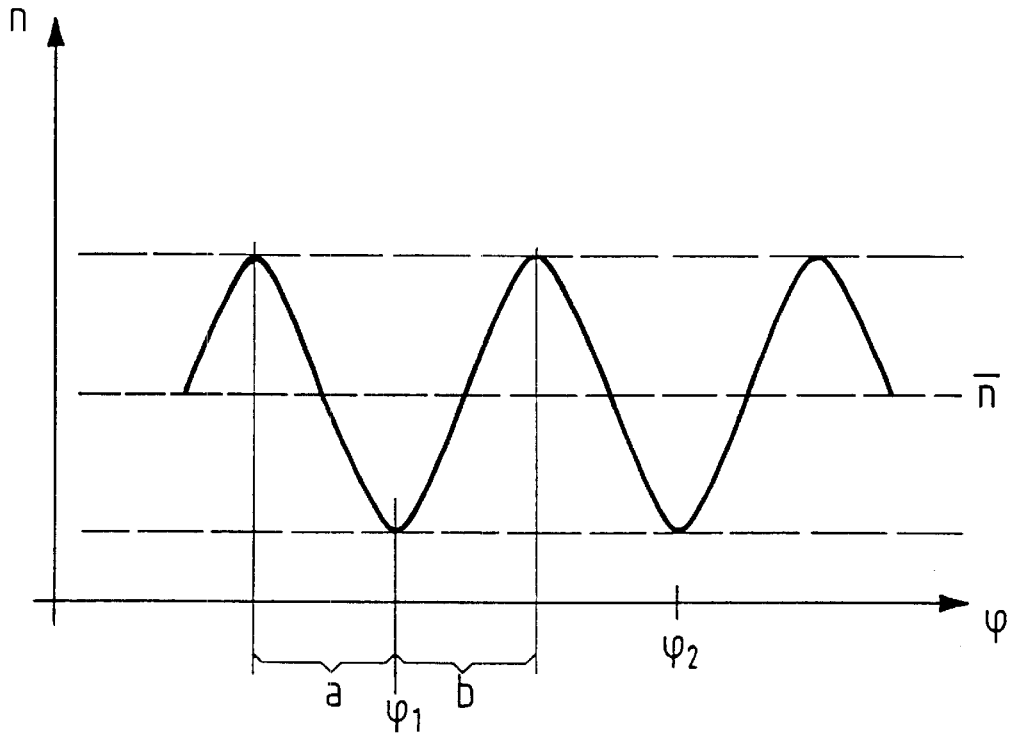
FIG. 2 shows a schematic diagram to depict the engine speed trend as a function of crank angle of a four-stroke internal combustion engine.

The diagram in FIG. 2 is intended to explain how the "optimal" starting angle can be determined (for example, with limited starting torque for any engine types and drive arrangements). FIG. 2 schematically shows the dependence of engine speed n on crank angle $\phi$ at constant torque of the electric starter machine. The specific wave-like trend is design-related, especially related to engine type, working volume, number of cylinders, bearing friction, compression ratio, etc. The regions a with diminishing speed n, followed by regions b with increasing speed n, accompany the repeating compression phases, followed by combustion phases, for example, of a four-stroke engine. The regions of greatest compression therefore lie in the regions of lowest speed, which are followed by a low-compression working phase of the internal combustion engine. If the values $\phi_i$ are chosen for crank angle, this corresponds to an "optimal" crankshaft position with reduced starting torque. In the case of a four-cylinder, four-stroke internal combustion engine, the starting angles $\phi_i$ are about 180° from each other, since the two outer and two inner cylinders run synchronously. A corresponding map is stored, for example, in the control device 11 in FIG. 1.

Figure 3:
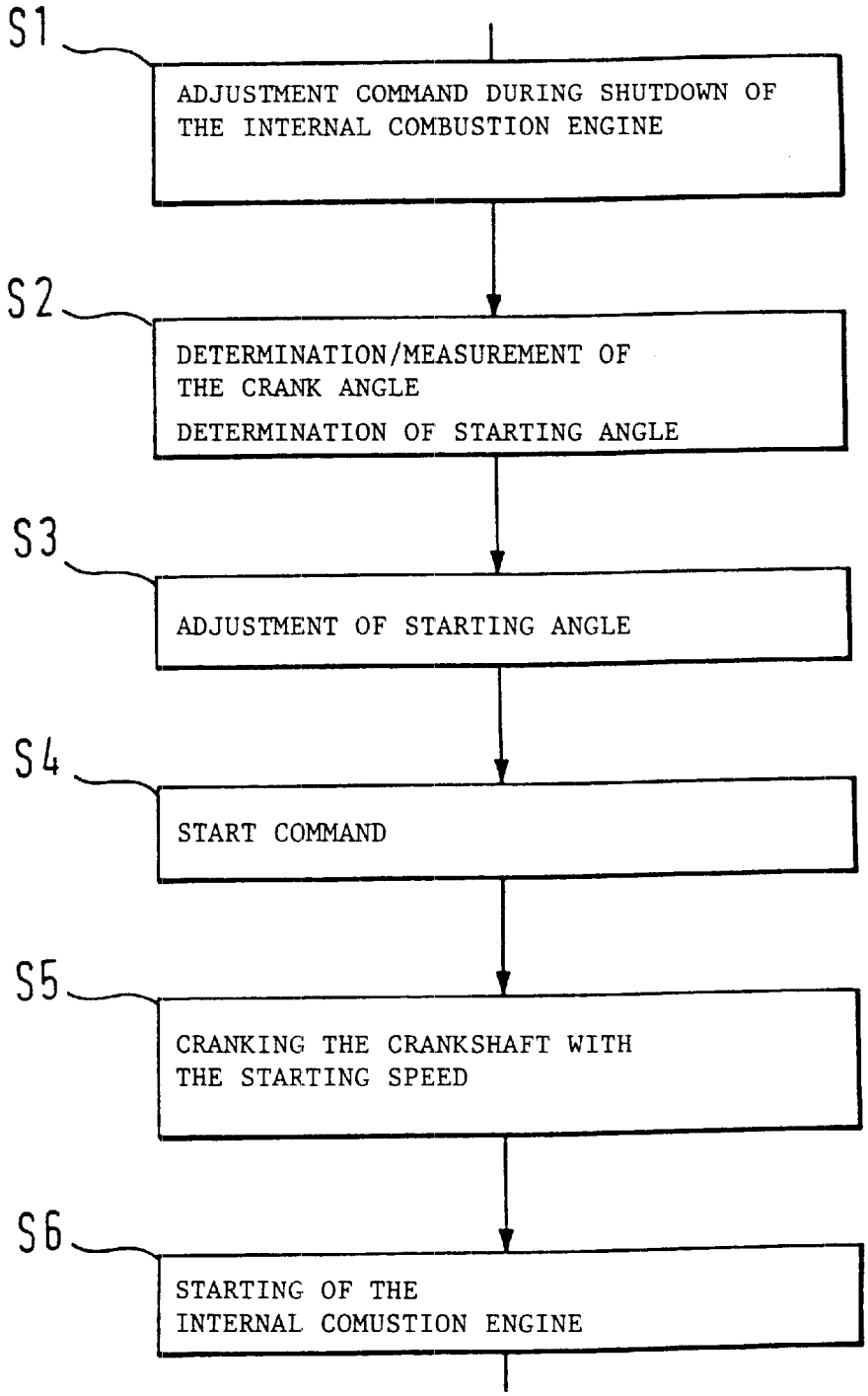
FIG. 3 shows a flowchart of a first process for starting an internal combustion engine.

In the flow chart according to FIG. 3, a first process variant for starting with reduced starting torque is explained. In step S1, a command to adjust the crankshaft starting angle occurs at or just after disengagement of the internal combustion engine 1 (for example, by disengaging ignition in the vehicle). A direct measurement of the crank angle or measurement of the rotor angle of the electric starter machine 4 and derivation of the crank angle then occurs in step S2. The control device 11 also determines the desired starting angle of crankshaft 2 and the optionally required crank angle change, in order to set the desired starting angle. The crankshaft 2 is then brought in step S3, by means of the electric machine 4, into the desired crank angle position for the next start by braking or accelerating the crankshaft in the runout phase of the engine. Steps S2 and S3 can also be continuously repeated during engine shutdown, in order to ensure that no undesired change of the starting angle occurs to the next start. On a start command in step S4, which initiates the actual starting process, the crankshaft 2 of the internal combustion engine 1 is cranked by the electric machine 4 to a stipulated starting speed in step S5. In the subsequent step S6, the internal combustion engine 1 (after the typical starting time elapses) then starts. In an internal combustion engine with direct injection, the starting time can also be allowed to elapse between steps S5 and S6 only until the fuel is injected (i.e., the internal combustion engine 1 is driven for a specified time without fuel mixing), to achievement of the starting speed and optionally even farther.

Figure 4:
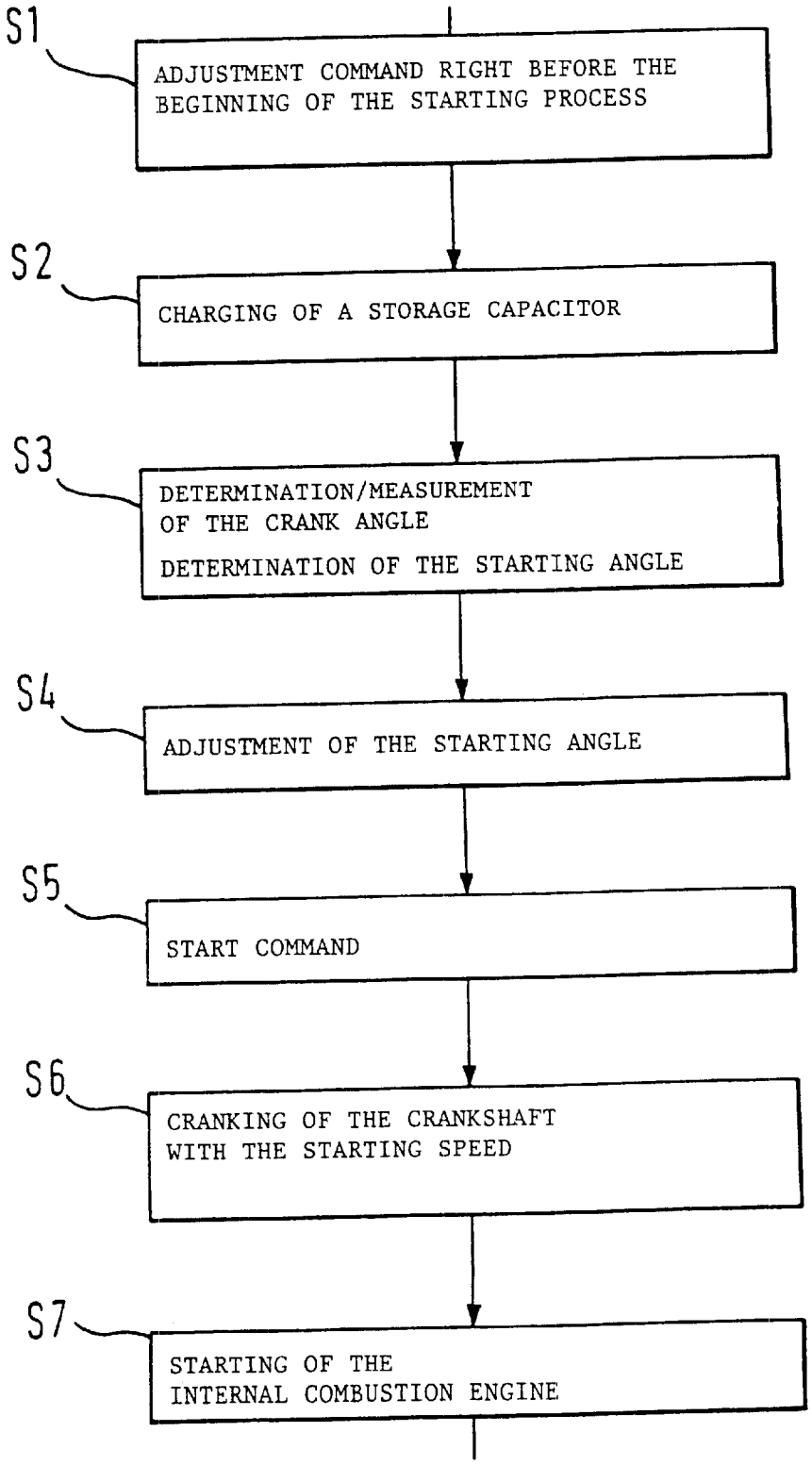
FIG. 4 shows a flowchart of a second process for starting an internal combustion engine.

In the process variants according to FIG. 4, the command to adjust the desired starting angle in step S1 is only given right before the beginning of the next starting process. This can be initiated in the vehicle, for example, by opening the central locking device 13, which is in communication with the control device 11 as shown in FIG. 1. In this variant, the capacitor accumulator 10 is also used as the energy source for all or part of the power required for starter operation. The capacitor accumulator 10 is then charged for the next starting process from battery 9, initiated by the adjustment command in step S1, mostly during longer engine shutdowns (step S2). The charging level of the capacitor accumulator 10 required for reliable starting can also be chosen as a function of the engine and/or outside temperature. The subsequent steps S3 to S7 then correspond essentially to steps S2 to S6 of the process according to FIG. 3. The present process is only modified to the extent that, in step S6, all or part of the power required for operation of the electric machine 4 originates from the capacitor accumulator 10.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A method for starting an internal combustion engine comprising the steps of:

a) employing an electric motor to bring a crankshaft of the internal combustion engine to a predefined crank angle at a time that is at least one of (i) before starting the internal combustion engine and (ii) before stopping the internal combustion engine;

b) responding to a start command by accelerating the crankshaft of the internal combustion engine from the predefined crank angle to at least a speed sufficient for starting the internal combustion engine; and c) taking at least some of the power required to start the engine from a short-term energy accumulator arranged in an intermediate circuit of an inverter of the electric motor;

wherein the energy accumulator is charged from a battery for a next starting process upon receipt of a command for adjustment of the crankshaft to the predefined crank angle and a charging level of the energy accumulator required for reliable starting is chosen as a function of at least one of an engine characteristic and an outside temperature.

2. A method as defined in claim 1 wherein the predefined crank angle is a crank angle at which a torque moment is substantially minimized.

3. A method as defined in claim 2 wherein the internal combustion engine comprises a four-stroke internal combustion engine, and the predefined crank angle is located at an end of a compression stroke of the engine.

4. A method as defined in claim 2 wherein the predefined crank angle is located in a region right after top dead center.

5. A method as defined in claim 1 wherein the predefined crank angle is a crank angle at which a starting time of the engine is substantially minimized.

6. A method as defined in claim 5 wherein the internal combustion engine comprises a four-stroke internal combustion engine with manifold injection, and the predefined crank angle is located at a beginning of a suction stroke of the engine.

7. A method as defined in claim 5 wherein the internal combustion engine comprises a four-stroke internal combustion engine with direct injection, and the predefined crank angle is located at the end of a suction stroke of the engine.

8. A method as defined in claim 1 wherein the internal combustion engine comprises a multicylinder internal combustion engine, and the predefined crank angle is chosen with consideration as to which of several cylinders is ignited first.

9. A method as defined in claim 1 wherein the predefined crank angle is automatically set at a time which is one of (a) when the internal combustion engine is turned off, or (b) immediately after the internal combustion engine is turned off.

10. A method as defined in claim 1 wherein the predefined crank angle is automatically set immediately before a beginning of a starting process.

11. A method as defined in claim 1 wherein the predefined crank angle is automatically set in response to opening of a vehicle lock.

12. A method as defined in claim 1 wherein the predefined crank angle of the internal combustion engine is derived from an angle position of a rotor of the electric motor.

13. A starter system comprising:

an internal combustion engine having a crankshaft;

an electric motor having a rotor which is operatively connected to the crankshaft of the internal combustion engine, the electric motor being adapted to accelerate the crankshaft to at least a speed which is sufficient to start the internal combustion engine;

means for identifying a crank angle of the crankshaft of the internal combustion engine; and a control device in communication with the identifying means and the electric motor for moving the crankshaft to a predefined crank angle for a later starting process;

wherein at least some of the power required for starting is taken from an energy accumulator that is arranged in an intermediate circuit of an inverter, the energy accumulator is charged from a battery for a next starting process upon receipt of a command for adjustment of the crankshaft to the predefined crank angle and a charging level of the energy accumulator required for reliable starting is chosen as a function of at least one of an engine characteristic and an outside temperature.

14. A starter system as defined in claim 13 wherein the control device employs a rotor angle of the electric motor to derive the crank angle of the crankshaft of the internal combustion engine.

15. A starter system as defined in claim 14 wherein the identifying means comprises a rotation angle sensor connected to the rotor of the electric motor.

16. A starter system as defined in claim 13 wherein the internal combustion engine is a four-stroke engine with one of (a) manifold injection and (b) direct injection which is designed for use in passenger cars.

17. A starter system as defined in claim 16 wherein the control device operates such that injection and ignition of fuel in a combustion chamber of the internal combustion engine only occur after a starting speed of the crankshaft is reached.

18. A starter system as defined in claim 13 wherein the electric motor comprises a starter/generator.

19. A starter system as defined in claim 13 wherein the electric motor comprises an inverter-controlled three-phase machine.

20. A starter system as defined in claim 13 wherein the energy accumulator comprises a combination of at least one of electrical capacitor elements and electrochemical battery elements.

* * * * *